US006834825B2

(12) United States Patent
Pollastrelli et al.

(10) Patent No.: US 6,834,825 B2
(45) Date of Patent: Dec. 28, 2004

(54) STRIP WINDING AND UNWINDING DEVICE WITH AUTOMATIC CENTERING

(75) Inventors: Alberto Pollastrelli, Sarde (IT); Angelo Coari, Rho (IT)

(73) Assignee: SMS Demag Innse SpA, Milan (IT)

( * ) Notice: Subject to any disclaimer, the term of this patent is extended or adjusted under 35 U.S.C. 154(b) by 0 days.

(21) Appl. No.: 10/220,060

(22) PCT Filed: Feb. 16, 2001

(86) PCT No.: PCT/EP01/01812

§ 371 (c)(1),
(2), (4) Date: Nov. 6, 2002

(87) PCT Pub. No.: WO01/64364

PCT Pub. Date: Sep. 7, 2001

(65) Prior Publication Data

US 2003/0089811 A1 May 15, 2003

(30) Foreign Application Priority Data

Feb. 28, 2000 (IT) ..... MI2000A0367

(51) Int. Cl.[7] ..... B65H 75/24

(52) U.S. Cl. ..... 242/534.1; 242/563.1; 242/578; 242/592

(58) Field of Search ..... 242/534.1, 563.1, 242/578, 592

(56) References Cited

U.S. PATENT DOCUMENTS

| | | | | | |
|---|---|---|---|---|---|
| 3,477,655 | A | | 11/1969 | Anderson | |
| 4,210,294 | A | * | 7/1980 | Jansen | 242/563.1 |
| 4,434,947 | A | * | 3/1984 | Focke | 242/563.1 |
| 5,123,606 | A | | 6/1992 | Braun et al. | |
| 6,328,249 | B1 | * | 12/2001 | Ogawa et al. | 242/559.2 |

FOREIGN PATENT DOCUMENTS

DE 3241870 A1 5/1984

* cited by examiner

*Primary Examiner*—Kathy Matecki
*Assistant Examiner*—Sang Kim
(74) *Attorney, Agent, or Firm*—Griffin & Szipl, P.C.

(57) ABSTRACT

The invention relates to a device (12) for winding up and unwinding metal strips, used in particular for cold-rolling.

This device has a spindle (21) which is mounted inside a hollow shaft and onto which the strip is wound; for this purpose the spindle is rotated by a motor (20) which actuates the hollow shaft by means of a mechanical transmission. In accordance with a preferred embodiment, the position of the hollow shaft along the axis of rotation may be adjusted by means of hydraulic actuators, in such a way as to compensate for any winding defects in the coil present on the spindle.

7 Claims, 7 Drawing Sheets

STRIP WINDING AND UNWINDING DEVICE WITH AUTOMATIC CENTERING

BACKGROUND OF THE INVENTION

The invention relates to those devices used for winding up and/or unwinding coils of material during some industrial processes, as occurs, for example, during rolling of certain metal strips.

A typical example of the application of these devices is for multi-cylinder or Sendzimir cold-rolling mills.

In such rolling mills the strips are conveyed back and forth between a pair of opposite rotating rolls which are mounted inside a supporting stand, together with a series of reinforcing rolls according to the well-known "cluster" arrangement used in Sendzimir technology.

During each pass the strip to be rolled is unwound from a coil and wound onto another one, at opposite sides of the supporting stand: for this purpose the aforementioned coils are mounted on respective winding devices, commonly called "swift", to which the present invention relates.

These devices comprise a rotating spindle onto which the strip of the coils is wound (or unwound) and which is actuated by an associated motor, usually of the electric type, and, if necessary, a speed-reduction system depending on the circumstances.

The spindle can expand radially so as to lock the coil wound on it, exerting a force internally against its wound turns; this allows high torques to be applied to the coil so as to exert on the strip a tensile force which in Sendzimir rolling mills may reach values of a few tens of tonnes.

When rolling has been completed, the spindle is brought back into a retracted condition so as to allow extraction of the coil, which is performed by removing the latter axially from the spindle.

An important feature of the Sendzimir rolling process is the need for having coils where the strip is wound in a regular manner.

Indeed, if the coils to be rolled have winding defects, for example typically when the edges of the wound turns of strip material are not properly aligned so as to produce an arrangement which may be described as "telescopic", the risk of the strip breaking during rolling with a consequent interruption in the production cycle, increases substantially.

In this connection it should be pointed out that the Sendzimir rolling process is performed under fairly critical conditions for the strip, which is not only subject to the high tensile force mentioned above, but also to a feed speed between the working rolls in the order of 1000 m/min.: these parameters therefore require very precise working conditions in order to avoid breakage of the strip and therefore any defects, such as that mentioned above concerning winding of the coils, are not acceptable.

At present to overcome this drawback, in Sendzimir rolling mills the non-uniform coils before being processed are arranged on a special unwinding reel (see FIG. 1).

The latter is located sideways one of the two winding devices 2 and has its axis parallel to that of its spindle; it is also mounted on a carriage 3, whose wheels 4 move along rails 5 arranged parallel to this axis.

In this manner an irregular coil is unwound, at the beginning of the rolling operation, from the reel 1, causing the strip 6 to perform a first pass between the working rolls 7 at a low feed speed and under reduced tension; the strip is then wound up onto the farther winding device 2.

As the strip 6 is unwound from the reel 1, the carriage 3 on which it is mounted is displaced along the rails 5 so as to compensate for any irregularities in the coil wound on the reel; in other words, the movements of the carriage allow the strip to be unwound while keeping its edges aligned in a straight reference direction.

Consequently, the strip may be wound up again onto the spindle of the farther device 2, without the danger of producing turns having edges not aligned with each other.

Such a solution makes it possible to obtain the proposed result of uniformity of the coils wound onto the spindles of the winding devices; however, it has some important drawbacks.

First of all it can be easily seen that the rolling mill must be provided with a whole series of special equipment, including the carriage movable along rails and the reel mounted thereon, these being used only during the first pass of the strip carried out in order to eliminate the winding defects in the initial coil.

As a consequence it can be easily understood that this fact increases substantially the complexity of the whole plant, making it also disadvantageous from the point of view of exploiting its components, since some of them (i.e. the reel mounted on the carriage and the other apparatuses such as those shown in FIG. 1) operate only during the initial stage of the production cycle and are no longer used for rolling the strip material.

It is also obvious that the space required for installing the special equipment referred to above, increases significantly the overall dimensions of the entire rolling mill.

Finally, it must also be taken into account that the duration of the production cycle is increased by the step of unrolling the strip from the reel, which occurs at a slow strip feeding speed and under a tension less than that used during the actual rolling step, i.e. when the strip is wound onto one device 2 and unwound from the other device passing in between the working rolls 7.

An improvement to such state of the art can be found in U.S. Pat. No. 3,477,655 which discloses a winding device wherein the spindle is driven by a speed reducer gearing system.

It is therefore the object of the present invention to remedy this situation.

BRIEF SUMMARY OF THE INVENTION

In other words, its object is to provide a winding device having structural and operating features such that it is also able to work with coils wound non-uniformly, without the need for the abovementioned special equipment, in particular the reel mounted on the carriage movable along rails.

This object is achieved by a winding device whose features are set out in the appended claims.

BRIEF DESCRIPTION OF THE DRAWINGS

For better understanding the invention, a few non-limiting embodiments thereof are described herebelow with reference to the accompanying drawings in which.

DETAILED DESCIPTION OF THE INVENTION

With reference to these drawings, numeral 10 denotes overall a rolling mill of the Sendzimir type, in accordance with the present invention.

Figure 2:
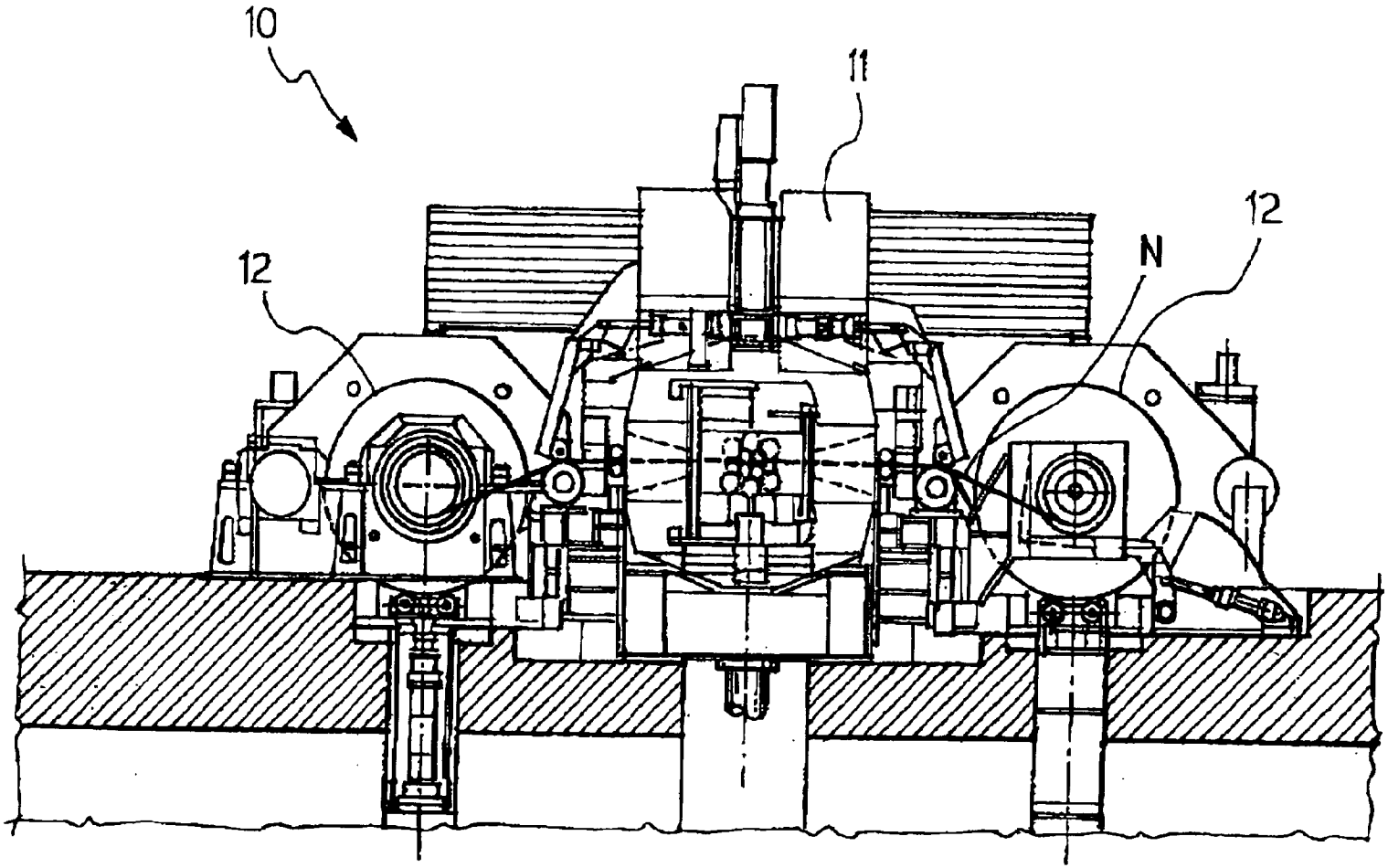
FIG. 2 shows a view, similar to the preceding one, of a Sendzimir rolling mill in which two winding devices according to the invention are present.

This rolling mill comprises a rolling stand 11 which accomodates the working rolls and is located between two winding devices 12, for winding up the rolled strip material N; these devices are identical to each other and are arranged with the strip winding axis perpendicular to the drawing sheet of FIG. 2.

A first embodiment of winding device 12 according to the invention is shown in detail in FIG. 3; since the devices in the rolling mill 10 are identical to each other, what will be stated below should be understood valid to both of them.

Figure 3:
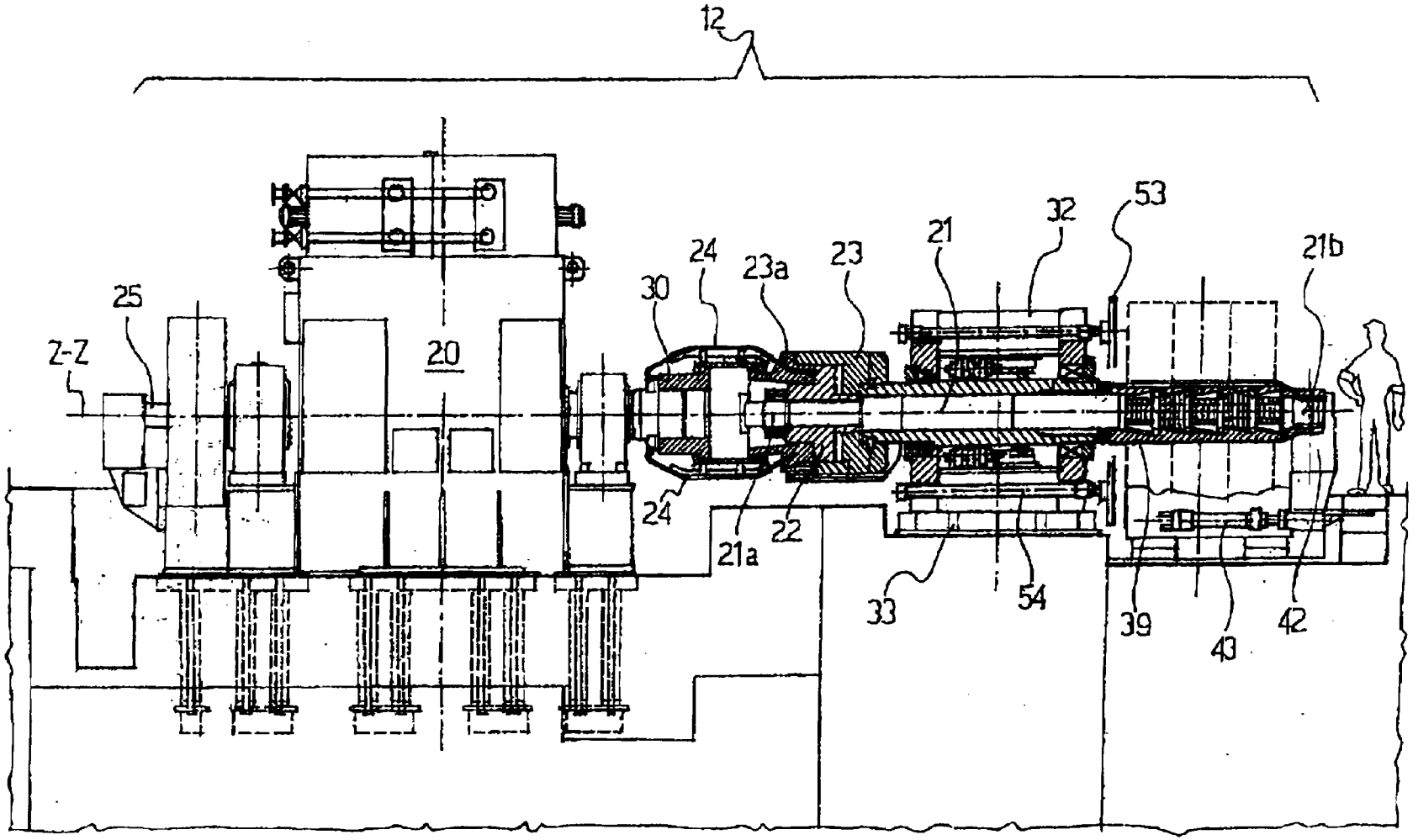
FIG. 3 shows a front and partially sectioned view of a first example of winding device according to the invention.

The device according to FIG. 3 is of the direct driving type, i.e. comprising an electric motor 20 that rotates a spindle 21 on which the strip N is wound, without an intermediate speed-reducing stage.

As can be seen from the drawings, a hydraulic unit is operative on the tang section 21*a* of the spindle 21, said unit consisting of a piston 22 fixed onto said spindle and sliding inside an outer cylindrical chamber 23; the oil necessary for operation of the hydraulic unit is supplied via flexible pipes 24 which are connected, on the one hand, to the cylindrical chamber 23 and on the other hand, to a rotary device 25 for dispensing the oil under pressure.

The cylindrical chamber 23 has an end wall 23*a* which extends concentrically with respect to the end section 21*a* of the spindle and terminates in a toothing 27; the latter consists of straight teeth and is coupled with a corresponding toothing 28 formed in a sleeve 29 mounted coaxially with the spindle 21.

The sleeve 29 is in turn integral with an extended operating section 30 which is made to rotate by the motor 20.

On the side opposite to that of the end wall 23*a,* the chamber 23 is connected to a hollow shaft 31 slidably coupled to the central part of the spindle 21, basically forming a single rigid element therewith.

The hollow shaft 31 is rotatably supported with respect to the winding axis Z of the device 12 by a casing 32 positioned on a base 33; to this purpose, for journalling the shaft 31, rolling bearings 34 and 35 are provided inside the casing.

In particular, these bearings preferably comprise cylindrical rollers and have an internal race (i.e. that applied to the hollow shaft) with a greater width and without retaining edges; in this way the hollow shaft 31, being integral with the internal race of the bearings, is free to move axially with respect to the outer part of the latter (and the cylindrical rollers) in accordance with what will be better explained later.

The hollow shaft 31 is locked in rotation with the spindle 21 by means of a toothed coupling 37 beyond which there projects the front part of the spindle whereon the strip coil N (whose profile is shown in broken line in FIGS. 3 and 4) is wound.

Figure 4:
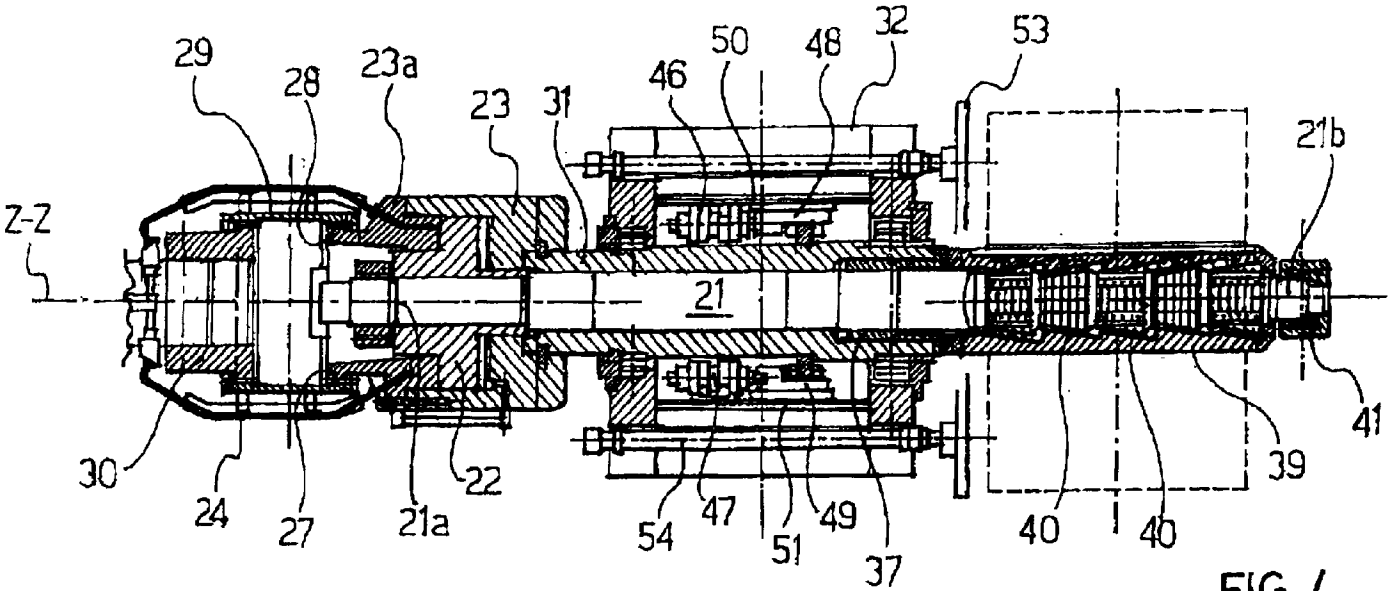
FIGS. 4 and 5 show an enlarged view of respective details of FIG. 3.

This part of the spindle is of a type already known per se and allows the radial expansion of some elements 39 located on the outside thereof, following an axial movement of the spindle to the left With reference to FIGS. 3 and 4; this is due to the presence of some frusto-pyramidal surfaces 40 which are formed on the surface of the spindle and push the aforementioned elements radially outwards, when the spindle moves to the left.

As stated, this expansion movement has the function of locking more stably the coil on the spindle, so that it is able to withstand the high tensile forces arising when the strip is wound and unwound during rolling.

It just matters to be added that expansion of the spindle 21 is reversible in the sense that when it moves axially to the right, the external elements 39 return into an initial retracted position so as to allow axial extraction of the coil of strip material.

In order to allow this operation to be performed, the tip 21*b* of the spindle 21 is supported by a bearing 41 mounted in a so-called "gate" 42, that is to say a shutter pivotably mounted about a vertical axis (i.e. perpendicular to the axis Z) and actuated by means of a hydraulic cylinder 43 located at the base thereof, so that it can be rotated about the pivoting axis and moved away from the spindle to allow axial extraction of the coil.

Figure 5:
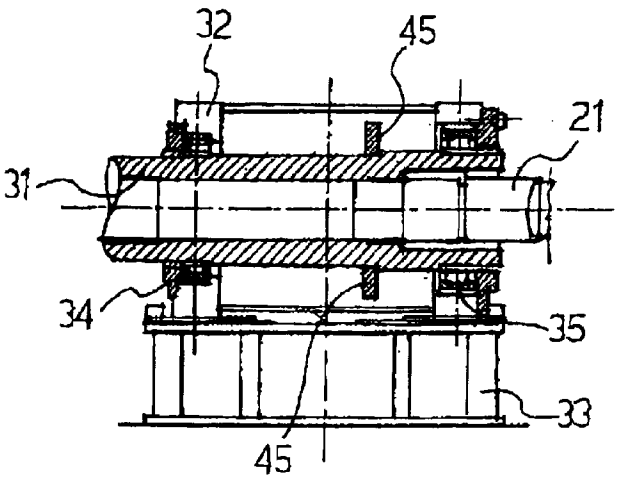

The hollow shaft 31 is provided with a collar 45 (visible more clearly in FIG. 5) projecting radially therefrom; actuators 46, 47 which are fixed to the casing 32, act on this collar.

In particular these actuators exert an action on the collar 45 directed parallel to the axis Z, forwards or backwards, depending on the circumstances as will be seen more clearly below, by means of respective sliders 48, 49 movable along corresponding guides 50, 51 formed on the casing; for this purpose the sliders are joined to the actuators and have a C-shaped configuration which mates with the collar 45 projecting from the spindle 21.

The actuators 46, 47 are preferably hydraulic and are feedback controlled by a position ring on the basis of detection of the profile of the strip N, which may be carried out using systems (also called strip scanners) of optical, electromagnetic type or others.

Finally, it can be seen how the winding device 12 also has internally a shoulder 53 for retaining the coil present on the spindle, displaceable by means of hydraulic cylinders 54 fixed to the casing 32.

Operation of the rolling mill 10, wherein two winding devices 12 like that described above are used, is explained below.

Figure 1:
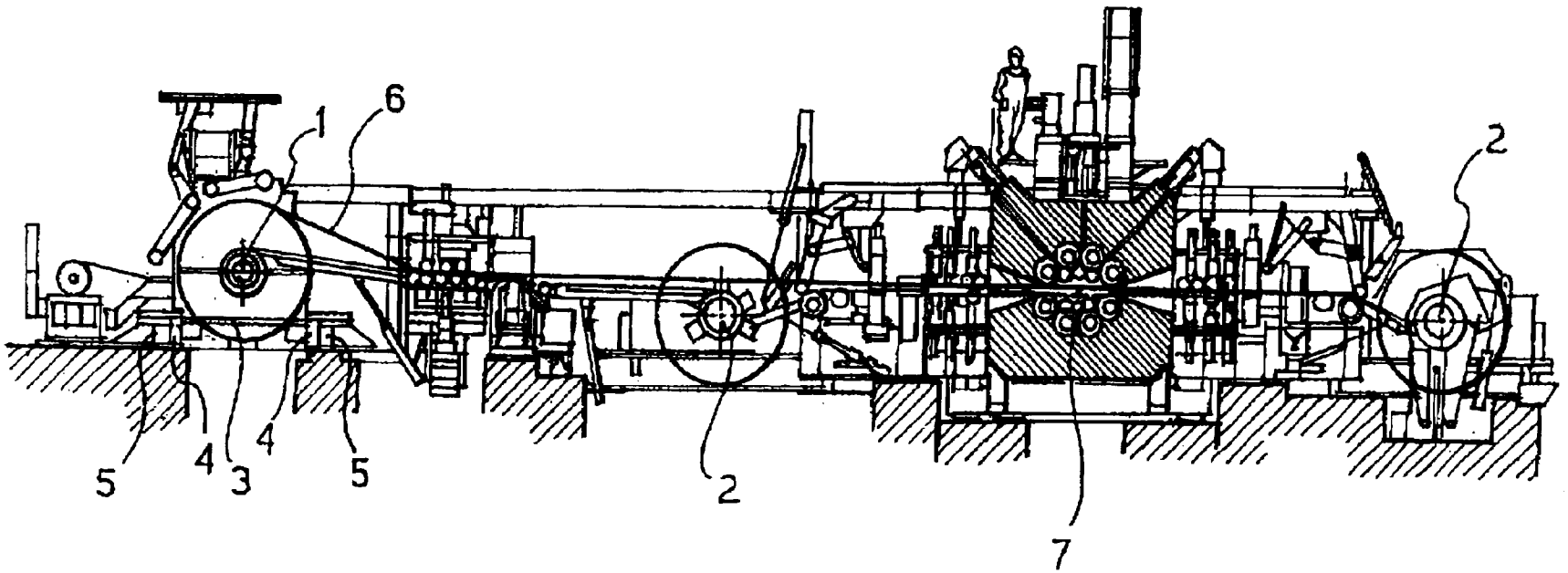
FIG. 1 shows laterally, as already stated, a Sendzimir rolling mill according to the prior art.

First of all it must be noted that the reel 1 mounted on the carriage 3 and all the other parts which in the prior art (c.f. FIG. 1) served to apply the strip onto the winding devices before starting rolling operation, have been eliminated.

This is made possible by the fact that in the device 12 according to the invention, the spindle 21 may be displaced axially by the actuators 46 and 47 so as to allow uniform winding of the strip N.

Indeed, when a wound with non-aligned edges (in "telescopic" manner) has to be rolled in the rolling mill 10, it is mounted on the spindle 21 of one of the two winding devices 12.

For this purpose, after it has been inserted onto the spindle, the latter is retracted by actuating the hydraulic unit using oil supplied via the pipes 24; during this step, the piston 22 fixed onto the tang section 21*a* moves to the left with reference to FIGS. 3 and 4, such that the spindle integral therewith moves in the same direction and its frusto-pyramidal surfaces 40 cause the elements 39 to expand, locking the coil on the spindle.

The piston 22 is then kept in this position so that the spindle 21 remains locked inside the hollow shaft 31 which is integral with the cylindrical chamber 23 where the piston is housed.

Consequently in this condition the hollow shaft 31, the spindle 21, the piston 22 and the cylindrical chamber 23 form together a rigid body.

The latter may either rotate with respect to the axis Z and translate longitudinally with respect thereto.

Rotation is obtained as a result of engagement between the toothing 28 of the sleeve 29 and the toothing 27 on the end wall 23*a* of the cylindrical chamber: this engaged arrangement transmits, in fact, the rotational movement imparted by the extended section 30 connected to the motor, to the rigid body mentioned above. It should be considered in this connection that the spindle 21 is connected to the hollow shaft 31 by means of the toothed coupling 37.

The axial translation of the aforementioned rigid body, on the other hand, is obtained as a result of the action exerted by the actuators 46 and 47 on the collar 45.

Indeed the latter is formed on the hollow shaft 31 and is therefore movable together therewith, while the actuators are fixed to the casing 32 and therefore are immobile.

As mentioned before, at the beginning of the rolling operation a non-uniformly wound coil is arranged on one of the two winding devices 12, of the Sendzimir rolling mill 10; the end of the strip N is then fixed on the spindle 21 of the other winding device, causing it to pass between the rolls of the rolling stand 11.

At this point rolling may start fully, namely under the conditions of high speed and high tensioning of the strip N which are normally used, without the risk of any tearing even though the strip is unwound from an initial coil having a non-uniform edge.

This result is obtained owing to the possibility of axial movement of the spindle 21 on which this coil is wound up and which, as mentioned above, forms a rigid body with the hollow shaft 31.

Indeed, during rolling the profile of the edge of the strip unwound from the non-uniform coil is detected by the devices referred to above (e.g. strip scanners); this detection allows the general control system of the rolling mill to perform the feedback adjustment of the actuators 46 and 47 so that the latter displace the respective sliders 48, 49 and, with them, the collar 45 of the hollow shaft 31.

Consequently the axial position of the latter and, in particular, that of the spindle 21 inside it may be adjusted in an instantaneous manner, so as to correct alignment of the edge of the strip N as it is gradually unwound from the initial coil (i.e. the telescopically wound coil).

It should just be pointed out that the spindle and the hollow shaft move together with the cylindrical chamber 23 and the piston 22 located inside it, forming the abovementioned rigid body together therewith; this body may slide axially with respect to the sleeve 29 which transmits the rotation of the motor, owing to the straight toothings 27 and 28 which allow the possibility of mutual displacement in the longitudinal direction.

As a result of that, the strip can be directed towards the rolling rolls inside the stand 11 correctly and precisely, so as to avoid the risk of breakages and tears due to feeding thereof in a non perfectly transverse manner to said rolls.

In other words, it may be considered that in the winding device 12 according to the invention, the axial displacements of the spindle 21 (together with the entire rigid body of which it forms part) following the adjustment performed by means of the actuators 46 and 47, correspond to the displacements which in the prior art of FIG. 1 were performed along the rails 5 by the carriage 3 on which the reel 1 is arranged, when the initial irregular coil is unwound before start of rolling.

As can be seen, therefore, the invention allows unwinding of the coils wound up with an incorrectly aligned edge, without all the drawbacks of the known art, namely without the need for the carriage on the rails and all the other equipment present in the state of the art, which hinder and slow down rolling of the strips.

Figure 6:
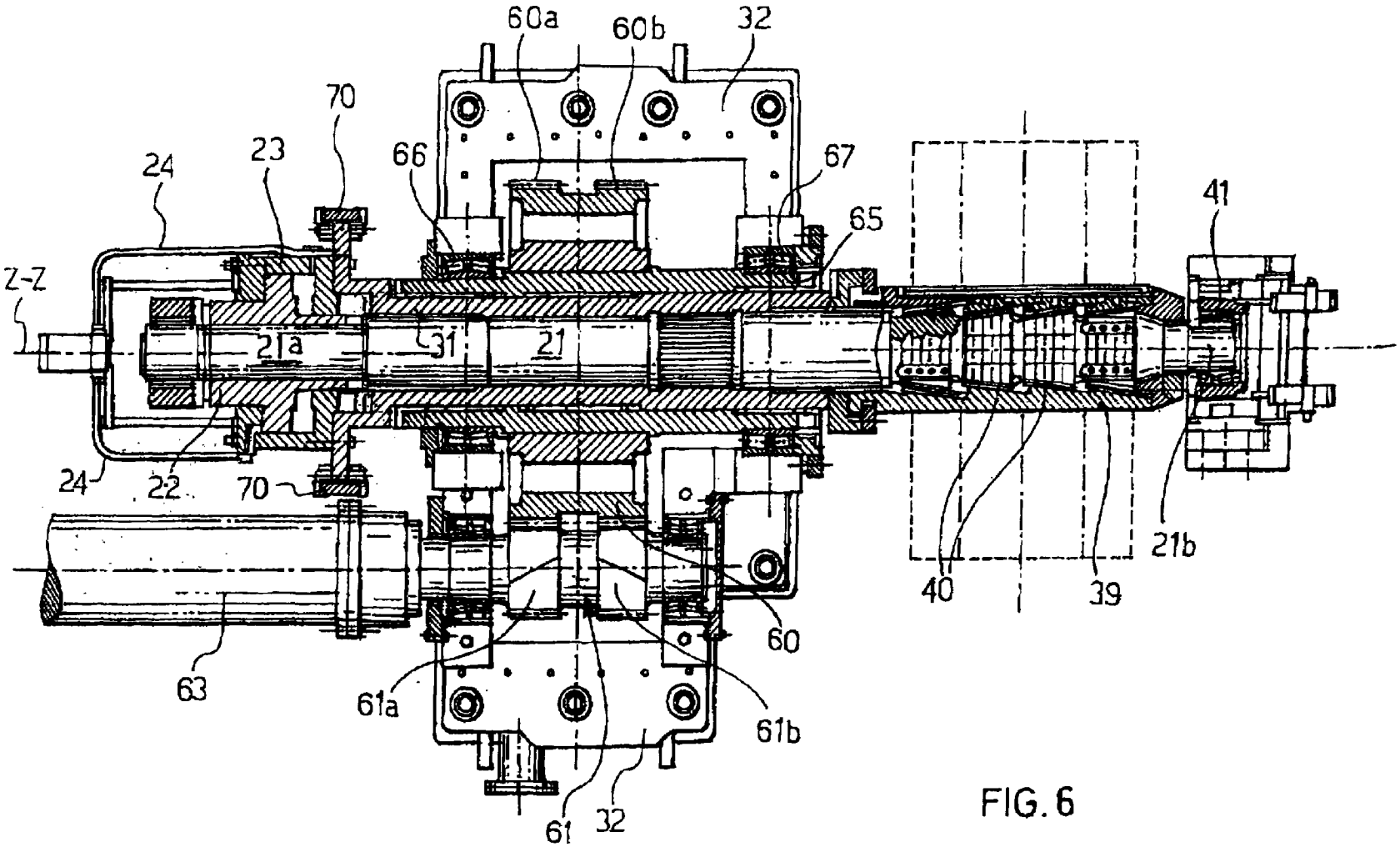
FIGS. 6, 7 and 8 show the longitudinal section of respective examples of winding devices according to the invention.
Figure 7:
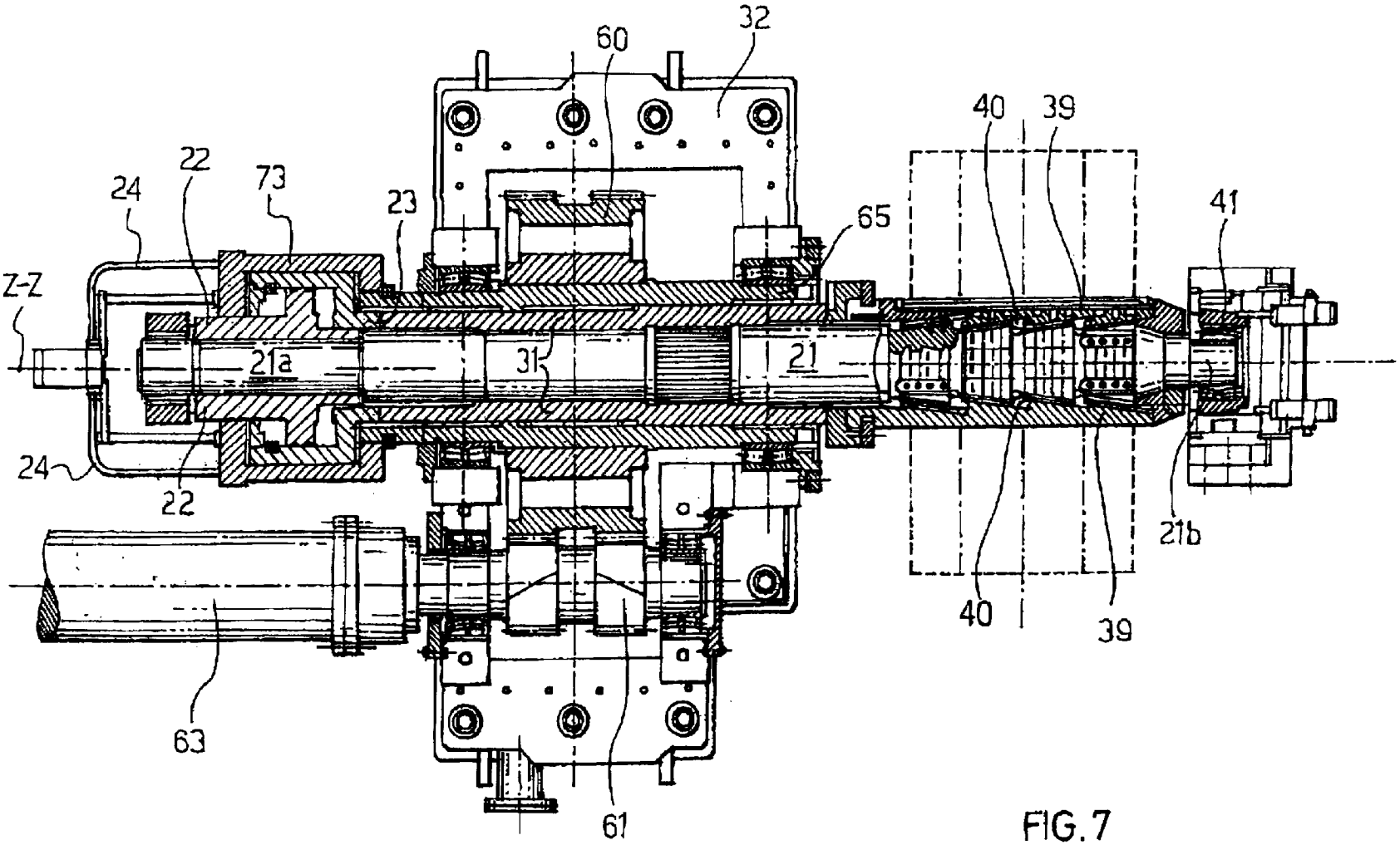
Figure 8:
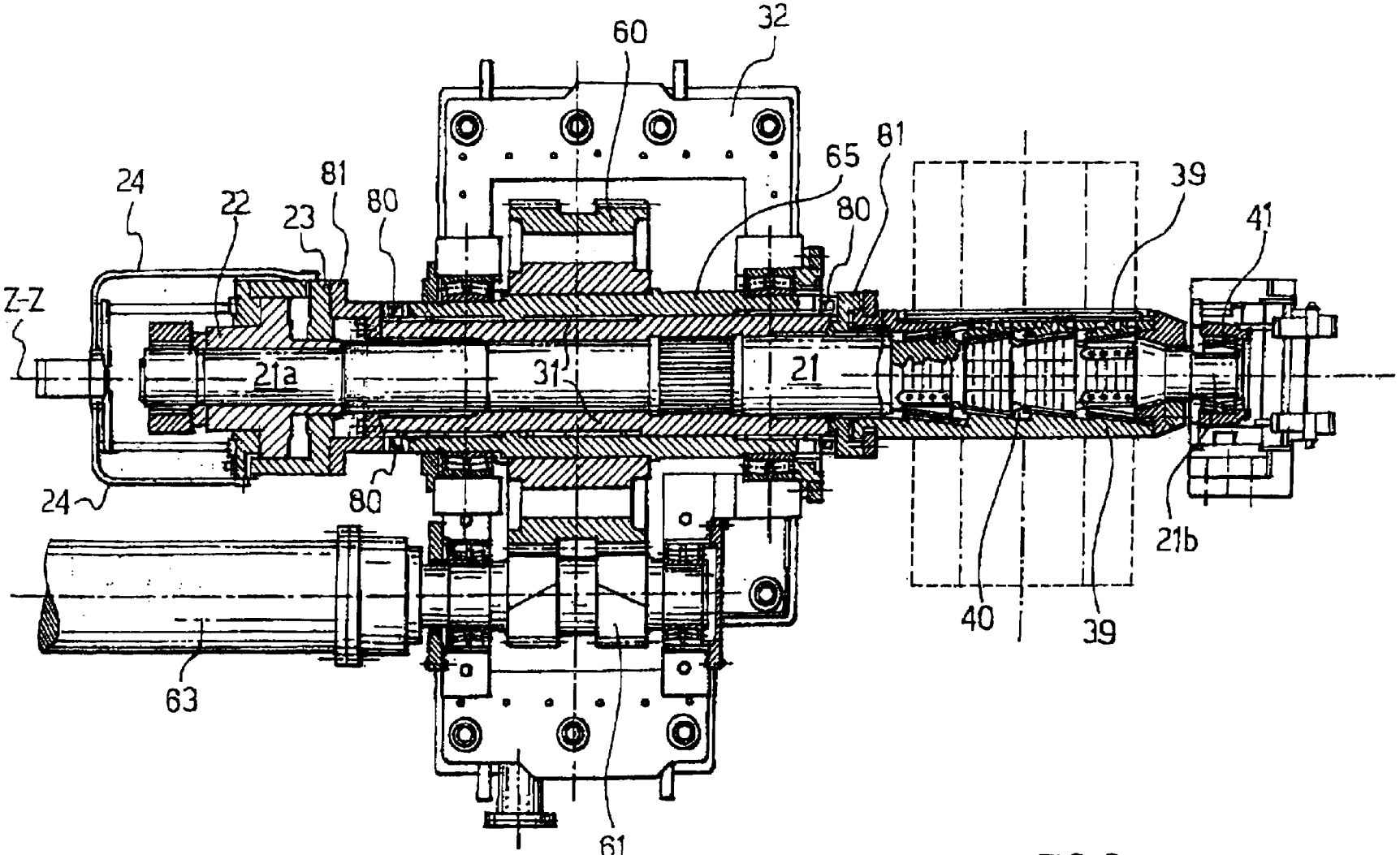

Obviously variations of the invention are possible with respect to the example thereof considered hitherto; some of them are shown in FIGS. 6 to 8 wherein the parts structurally or functionally equivalent to those considered above are indicated by same numbering and are therefore not described in further detail.

In these variations the spindle 21 is made to rotate by means of a speed reducer.

This type of actuating system, which is already known in the art, consists of a gearing formed by a wheel 60 with two bands of oppositely directed helical teeth 60*a*, 60*b*, mounted coaxially with the spindle 21 and engaging with a pinion 61, also having a double set of teeth 61*a*, 61*b*. The pinion is operated by the motor 20 through an extended arm 63.

Since, in this case, it is not possible to provide, on the hollow shaft 31 where the spindle 21 is housed, a collar as in the example above (the presence of the toothed wheel 60 prevents this possibility), the axial displacements of the spindle are now obtained in the following manner.

The hollow shaft 31 is in turn housed so as to be slidable axially inside a tubular body 65 and locked in rotation therewith by means of a straight-tooth coupling.

The tubular body 65 is also supported by bearings 66 and 67 (one of which—with the function of a thrust bearing—is axially fixed), so as to be free to rotate with respect to the winding axis Z and to remain fixed axially with respect to the casing 32. The toothed wheel 60 is also keyed onto the tubular body 65.

The hollow shaft 31 has, at its end directed towards the tang section 21*a* of the spindle, a flange 70 projecting radially outwards and fixed rigidly to the cylindrical chamber 23; actuators (not shown in the drawings) act on this flange in a manner similar to that considered in the preceding example with regard to the collar 45 formed on the hollow shaft.

In the light of this comparison it is possible to understand how operation of this second embodiment of the invention is substantially similar to that of the preceding one.

Indeed, also in this case the hydraulic unit formed by the cylindrical chamber 23 and the piston 22 fixed on the tang section 21*a* of the spindle causes sliding of the latter inside the hollow shaft 31, so as to produce expansion (or contraction) of the part on which the coil is wound.

Afterwards the rigid body formed by the hollow shaft 31, the cylindrical chamber 23 and the spindle 21 together with the piston 22 fixed onto its tang section, is made to rotate by the pinion 61 which is meshed with the toothed wheel 60 keyed onto the tubular body 65.

At the same time the actuators which act on the flange 70 adjust the axial position of the abovementioned rigid body and therefore the spindle 21, so as to obtain the same effects already explained before.

FIG. 7 shows another embodiment of winding device according to the present invention, which is also actuated by a reduction gearing of the type just considered; again the numbering of corresponding parts has been left unchanged in order to facilitate comprehension.

This latter embodiment differs from the preceding one in that the flange 70 acted on by the actuators for adjusting the axial position of the spindle 21 (integral with the hollow shaft 31), is replaced by an external hydraulic system.

The latter is essentially an additional hydraulic unit on the outside of that formed by the cylindrical chamber 23 and the piston 22 fixed onto the tang section 21*a* of the spindle.

Indeed, as can be seen from FIG. 7, on the outside of the first cylindrical chamber 23 rigidly fixed to the hollow shaft 31, there is a second cylindrical chamber 73 rigidly fixed to the tubular body 65; the latter therefore rotates freely and is axially locked with respect to the axis Z, likewise the body 65 with which it is solid.

The first and second cylindrical chambers 23 and 73 together form a hydraulic unit inside which the first chamber acts as a piston slidable back and forth inside the second chamber.

Consequently it can be easily understood that, in this situation, the axial movements of the spindle 21 integrally with the hollow shaft 31 (after the former has been locked inside the latter as already mentioned further above), are obtained by causing the first cylindrical chamber 23 to move inside the second chamber 73.

In this way, therefore, the axial position of the spindle 21 is controlled by means of the external hydraulic unit which to all effects functions in the manner of the actuators 46, 47 according to the first example described and illustrated in FIGS. 3 and 4.

This unit therefore performs correction of the axial position of the spindle on the basis of the profile of the strip detected by the strip scanners already mentioned.

It should be merely pointed out that in this case the external cylindrical chamber rotates integrally with the internal chamber 23, owing to the straight-tooth coupling which couples the hollow shaft 31 with the tubular body 65 on the outside thereof.

With reference to FIG. 8 it is possible to consider a last embodiment of the invention, which also concerns a winding device with spindle operated by means of a reduction gear.

The difference from the other two embodiments resides in the means which perform the axial displacements of the spindle.

The solution envisaged in this case consists of a pair of small hydraulic jacks 80 which operate, at the respective ends of the tubular body 65, against corresponding flanges 81 fixed to the ends of the hollow shaft 31.

Each of these jacks has the function of pushing the hollow shaft 31 and the spindle 21 inside it, kept immobile by the piston 22 inside the chamber 23, respectively towards the left and the right; in this way the abovementioned results regarding adjustment of the axial position of the spindle 21 during rolling, are achieved.

As mentioned initially, the winding devices for which the invention is intended are not only those used in Sendzimir rolling mills for metal strips, but may also be those used for winding up and unwinding coils of material (not only metal) in applications where difficulties may arise owing to non-uniformity of the edges of the wound coil.

Consequently variations of the invention other than those in the examples considered above are possible, said variations arising from possible adaptations thereof to winding devices for fields different from Sendzimir rolling technology.

All these and other possible variations nevertheless fall within the scope of the following claims.

What is claimed is:

1. Device for winding and unwinding strips, comprising:

a spindle for supporting coils of strip material;

an actuator means;

a hollow shaft comprising a collar disposed externally, the hollow shaft being coupled externally along at least a part of the spindle so as to be locked in rotation therewith about a longitudinal axis and so that the spindle is slidable along the longitudinal axis inside the hollow shaft until a predefined position for locking a coil mounted thereon; and means for rotating the hollow shaft together with the spindle about the longitudinal axis, wherein the hollow shaft is supported slidably along said axis and its sliding movements are controlled depending on the profile of the edge of the strip wound up on or unwound from the spindle;

wherein the actuator means operates against the collar to make the hollow shaft and the spindle slide back and forth along the longitudinal axis, depending on the profile of the edge of the strip wound up on or unwound from the spindle.

2. Device according to claim 1, wherein the means for rotating the hollow shaft together with the spindle comprises a first toothing with straight teeth on the left side of a cylindrical chamber provided at the end of the hollow shaft and coupled with a piston which operates the axial movements of the spindle, and a second toothing with straight teeth provided on a rotating sleeve rotating coaxially with the longitudinal axis.

3. Device according to claim 1, wherein said spindle and said hollow shaft are disposed to reversibly slidably couple to a state wherein said hollow shaft and said spindle are locked together in rotation.

4. Device for winding and unwinding strips, comprising:

a spindle for supporting coils of strip material;

an actuator means;

a hollow shaft comprising a radially projecting flange disposed at one end, the hollow shaft being coupled externally to the spindle along at least a part thereof, so as to be locked in rotation therewith about a longitudinal axis and so that the spindle is axially slidable inside the hollow shaft until a predefined position for locking a coil mounted thereon; and a toothed wheel actuated by a pinion for rotating the hollow shaft together with the spindle about the longitudinal axis, wherein the hollow shaft is supported slidably along said axis and its sliding movements are controlled depending on the edge profile of the strip wound up on or unwound from the spindle;

wherein the hollow shaft is housed inside a tubular body which is locked in rotation with it about the longitudinal axis; and wherein the actuator means act against the radially-projecting flange to cause said axial sliding movement along the longitudinal axis, depending on the edge profile of the strip.

5. Device for winding and unwinding strips comprising:

a spindle for supporting coils of strip material;

a hollow shaft coupled externally to the spindle along at least a part thereof, so as to be locked in rotation therewith about a longitudinal axis and so that the spindle is axially slidable inside the hollow shaft until a predefined position for locking a coil mounted thereon;

a toothed wheel actuated by a pinion for rotating the hollow shaft together with the spindle about the longitudinal axis, wherein the hollow shaft is supported slidably along said axis and its sliding movements are controlled depending on the edge profile of the strip wound up or unwound from the spindle;

wherein the hollow shaft is housed inside a tubular body which is locked in rotation with it about the longitudinal axis, and in that a first cylindrical chamber is arranged at one end of the hollow shaft which is coupled with a piston operating the axial movements of the spindle, whereas a second cylindrical chamber is arranged at a corresponding end of the tubular body and is coupled with the first cylindrical chamber which acts as a piston for operating said axial sliding movement of the hollow shaft, depending on edge profile of the strip.

6. Device for winding and unwinding strips, comprising:

a spindle for supporting coils of strip material;

a plurality of jacks;

a hollow shaft comprising radially projecting flanges, the hollow shaft being coupled externally to the spindle along at least a part thereof, so as to be locked in rotation therewith about a longitudinal axis and so that the spindle is axially slidable inside the hollow shaft until a predefined position for locking a coil mounted thereon; and a toothed wheel actuated by a pinion for rotating the hollow shaft together with the spindle about the longitudinal axis, wherein the hollow shaft is supported slidably along said axis and its sliding movements are controlled depending on the edge profile of the strip wound up on or unwound from the spindle;

wherein the hollow shaft is housed inside a tubular body which is locked in rotation with it about the longitudinal axis; and wherein the jacks, active at opposite sides on the ends of the tubular body, operate against the radially projecting flanges so as to cause said axial sliding movement of the hollow shaft depending on the edge profile of the strip.

7. Device according to any of claims 4 to 6, wherein the toothed wheel and the driving pinion coupled thereto comprise respective opposite directed, double helical toothings.

* * * * *